United States Patent [19]

Proietto

[11] 4,209,219

[45] Jun. 24, 1980

[54] METHOD AND APPARATUS FOR TERMINATING MULTI-CONDUCTOR CABLE

[75] Inventor: Nazario Proietto, Mechanicsburg, Pa.

[73] Assignee: AMP Incorporated, Harrisburg, Pa.

[21] Appl. No.: 962,862

[22] Filed: Nov. 22, 1978

[51] Int. Cl.[2] ..... H01R 13/38

[52] U.S. Cl. ..... 339/99 R

[58] Field of Search ..... 339/97 P, 98, 99 R

[56] References Cited

U.S. PATENT DOCUMENTS

| | | | |
|---|---|---|---|
| 3,434,093 | 3/1969 | Wedekind | 339/99 R |
| 3,444,506 | 5/1969 | Wedekind | 339/99 R |
| 3,573,713 | 4/1971 | Enright et al. | 339/98 |
| 3,718,888 | 2/1973 | Pasternak | 339/98 |
| 3,816,818 | 6/1974 | Meier | 339/99 R |
| 3,820,055 | 6/1974 | Huffnagle et al. | 339/97 P |
| 3,820,058 | 6/1974 | Friend | 339/99 R |
| 3,899,236 | 8/1975 | Santos | 339/98 |
| 3,912,354 | 10/1975 | Campbell et al. | 339/99 R |
| 3,930,708 | 1/1976 | Wedekind et al. | 339/99 R |
| 3,936,128 | 2/1976 | D'Annessa et al. | 339/98 |
| 3,964,816 | 6/1976 | Narozny | 339/99 R |
| 4,005,518 | 2/1977 | Bakermans | 29/752 |
| 4,068,912 | 1/1978 | Hudson et al. | 339/99 R |

*Primary Examiner*—Joseph H. McGlynn
*Attorney, Agent, or Firm*—Russell J. Egan

[57] ABSTRACT

A method and apparatus are disclosed for terminating multi-conductor flat flexible cable while assuring that the conductors of the cable are on correct centerlines for proper termination. The termination is effected by inserting the cable into a connector having three members, namely, a terminal carrying member, and a pair of cable clamping members. The three members are juxtapositioned with respect to one another and the termination is accomplished with a single terminating stroke which accomplishes a sequential operation to first clamp the cable and then terminate the individual conductors thereof by engaging the conductors with individual insulation displacing terminals. The assembly is held in the terminated condition by both the interaction of the terminals with the members and portions of the assembled members with each other.

11 Claims, 5 Drawing Figures

10
82
16
76
86
76
80
84
76
74
74
72
70
64
68
56
60
52
14
56
50
54
52
54
58
66
62
48
54
26
42
40
44
46
38
30
46
42
38
32
24
44
40
32
34
28
22
18
34
22
36
12
20
36

METHOD AND APPARATUS FOR TERMINATING MULTI-CONDUCTOR CABLE

BACKGROUND OF THE INVENTION

1. The Field of the Invention

The present invention relates to a method and apparatus for terminating multi-conductor flat flexible cable and in particular to a device which clamps the cable to assure correct positioning of the conductors thereof prior to effecting an insulation displation termination of the individual conductors.

2. The Prior Art

There has been a problem existing in the mass termination of multi-conductor cable caused by the fact that the conductors of the cable are not always on the correct centerlines at the point of termination. Clearly if the conductor has wandered from its correct position, one of two conditions will occur when termination is attempted. Either the conductor will be pushed aside by the terminal and not make effective contact therewith or the conductor could be shoved into a shorting condition with an adjacent conductor. Neither of these two situations is desirable.

Since neither of the foregoing conditions is within the control of the connector manufacturer, a better method and apparatus for effecting correct termination is clearly required. The electrical connector manufacturers have attempted to seek ways in which to assure correct spacing of the conductors at the point of termination. Two examples of such methods can be found in U.S. Pat. Nos. 4,068,912 and 4,077,695. The first of these patents shows a connector which squeezes the cable to effect movement of the conductors to properly spaced intervals. The second noted patent shows a hand tool which causes the conductors to be driven to the desired location prior to effecting termination. The present invention constitutes an improvement over the first of the noted patents.

SUMMARY OF THE INVENTION

The subject connector is an assembly of three interacting members of insulative material. One base member holds a plurality of terminals in a fixed array. Each of the terminals has an insulation displacing, conductor engaging portion, formed by a pair of tines defining a conductor engaging slot therebetween, extending from a mating face of the base member. The other two members are the intermediate and cover members and have opposed mating faces which are profiled to define a plurality of transverse conductor passages which, when the intermediate and cover members are pressed against opposite sides of a multi-conductor flat flexible cable, will force the conductors thereof into aligned spaced positions. The intermediate and cover members also have an array of slots with each slot aligned with a respective terminal in the base member so that, after the cable is compressed between the intermediate and cover members, the base member can be applied to drive the terminals into engagement with the respective conductors of the cable.

It is therefore an object of the present invention to produce an improved multi-conductor cable termination device and method which will cause the cable to be first clamped in such a manner as to drive the conductors of the cable to aligned spaced positions and then terminate the individual conductors thereof.

It is another object of the present invention to produce an improved multi-conductor cable termination system which can be customer applied with assurance of correct termination of each conductor of the cable.

It is a further object of the present invention to produce a termination system which can be applied as a single preassembled unit to terminate a multi-conductor flat flexible cable in a single step which includes both conductor positioning and termination by insulation piercing terminals.

It is a further object of the present invention to produce a device for accurately terminating multi-conductor flat flexible cable which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
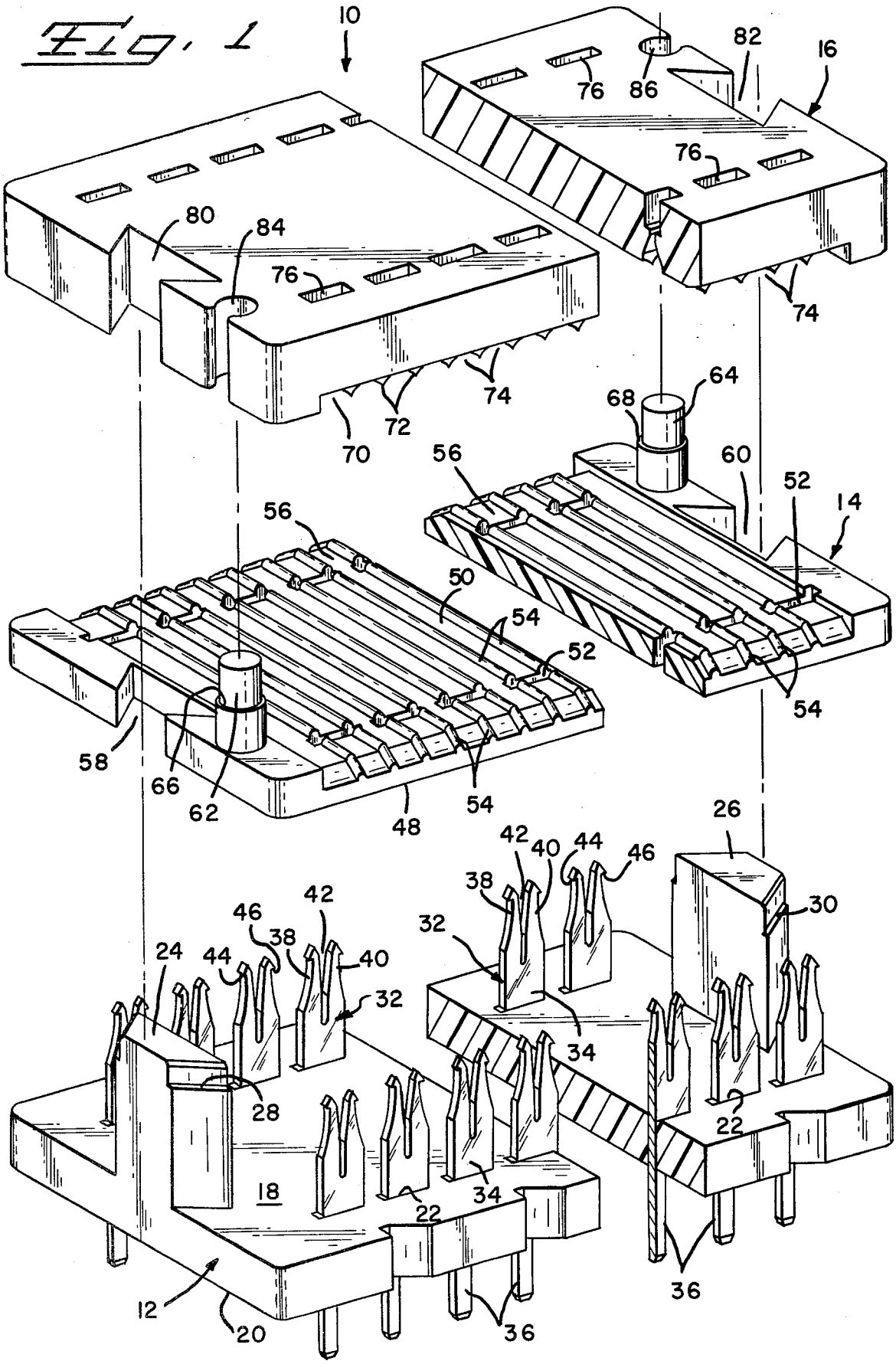
FIG. 1 is an exploded perspective view of an electrical connector according to the present invention.

The subject connector 10 has a base or first member 12, an intermediate or second member 14, and a cover or third member 16 formed from insulative material. The base member 12 has oppositely directed mating surfaces 18, 20 with an array of terminal passages 22 extending between the surfaces. The base member 12 is provided with connecting studs 24, 26 on opposite ends thereof extending from the first mating surface. Each stud has a step 28, 30, respectively, near the upper free end.

A terminal 32 is mounted in each passage 22 and includes first and second mating portions 34, 36 extending from the respective first and second mating surfaces. The first mating portion of each terminal is substantially the same as that disclosed in U.S. Pat. No. 3,820,055, the disclosure of which is incorporated herein by reference. Each portion 34 includes a pair of tines 38, 40 defining a slot 42 therebetween. Each tine has an outwardly directed shoulder 44, 46 on the free end thereof.

The intermediate member 14 also has oppositely directed mating surfaces 48, 50 with an array of terminal passages 52 extending therebetween. Each passage 52 is aligned with a respective passage 12 in the base member. Mating surface 48 is preferably planar while mating surface 50 is profiled by a plurality of parallel spaced ribs 54 defining a plurality of parallel conductor receiving channels 56. The intermediate member has a profiled recess 58, 60 at each end aligned to receive therein a stud 24, 26, respectively, of the base member 12. The intermediate member 14 is also provided with a pair of studs 62, 64 at opposite ends thereof and extending from the profiled mating surface 50. Each stud 62, 64 has a shoulder 66, 68.

The cover member 16 has a profiled mating surface 70 with a plurality of parallel spaced ribs 72 defining conductor receiving channels 74 therebetween. The cover is also provided with an array of profiled terminal passages 76 each of which has a shoulder 78 (see FIG. 3). The cover member has a profiled recess 80, 82 at each end thereof aligned to receive therein a respective stud 24, 26 of base member 12. The cover member is further provided with a pair of profiled recesses 84, 86 aligned to receive the studs 62, 64, respectively, of the intermediate member 14.

It should be noted that the studs 24, 26 and recesses 58, 60, 80, 82 are located substantially centrally in the ends of the respective members while studs 62, 64 and recesses 84, 86 are located in diametrically opposite corners of the respective members. This difference in location as well as difference in profile assures correct assembly of the subject connector, as will be explained later.

The connector 10 is preassembled by loading the terminals 32 into the base member 12 and then placing the intermediate member 14 on the studs 24, 26. It should be noted that the shoulders 28, 30 at the upper end of the studs will hold the intermediate member in a spaced apart condition with portions 34 of terminals 32 extending into slots 52 but not past surface 50 (see FIGS. 2 and 3). The cover member 16 is placed on the intermediate member 16 with studs 62, 64 being received in recesses 84, 86, respectively and with shoulders 66, 68 engaging surface 70 to hold the cover in position spaced above the intermediate member (see FIGS. 2 and 3).

It would, of course, be possible to preassemble the intermediate and cover members and place the assembly on the base member. It is also foreseen that the intermediate and cover members could be molded as a single unit held together by a frangible flange extending between the upper ends of studs 62, 64 and recesses 84, 86, respectively.

Figure 2:
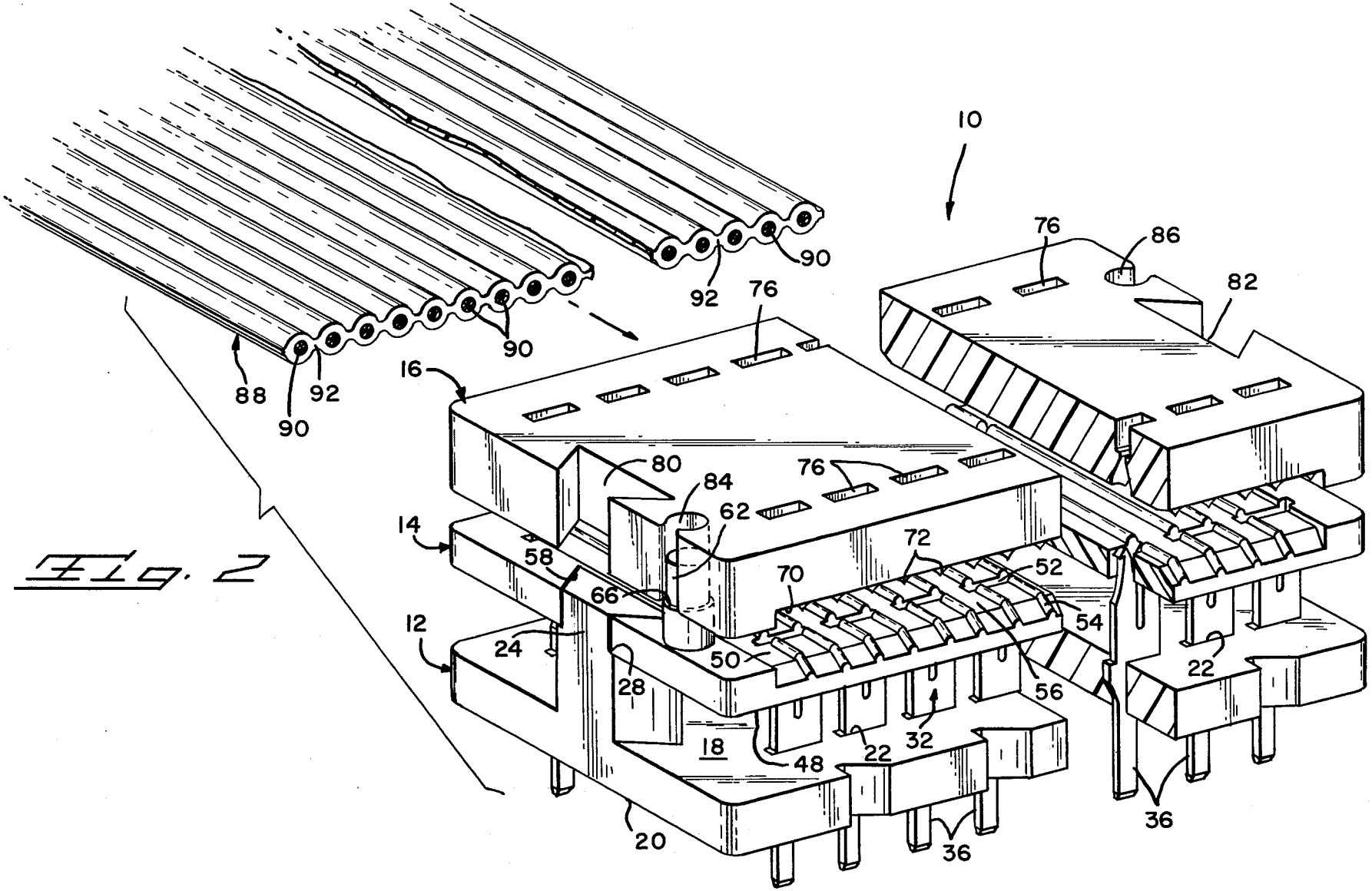
FIG. 2 is a perspective view, partially in section, showing the subject connector spaced from an end portion of a multi-conductor flat flexible cable.
Figure 3:
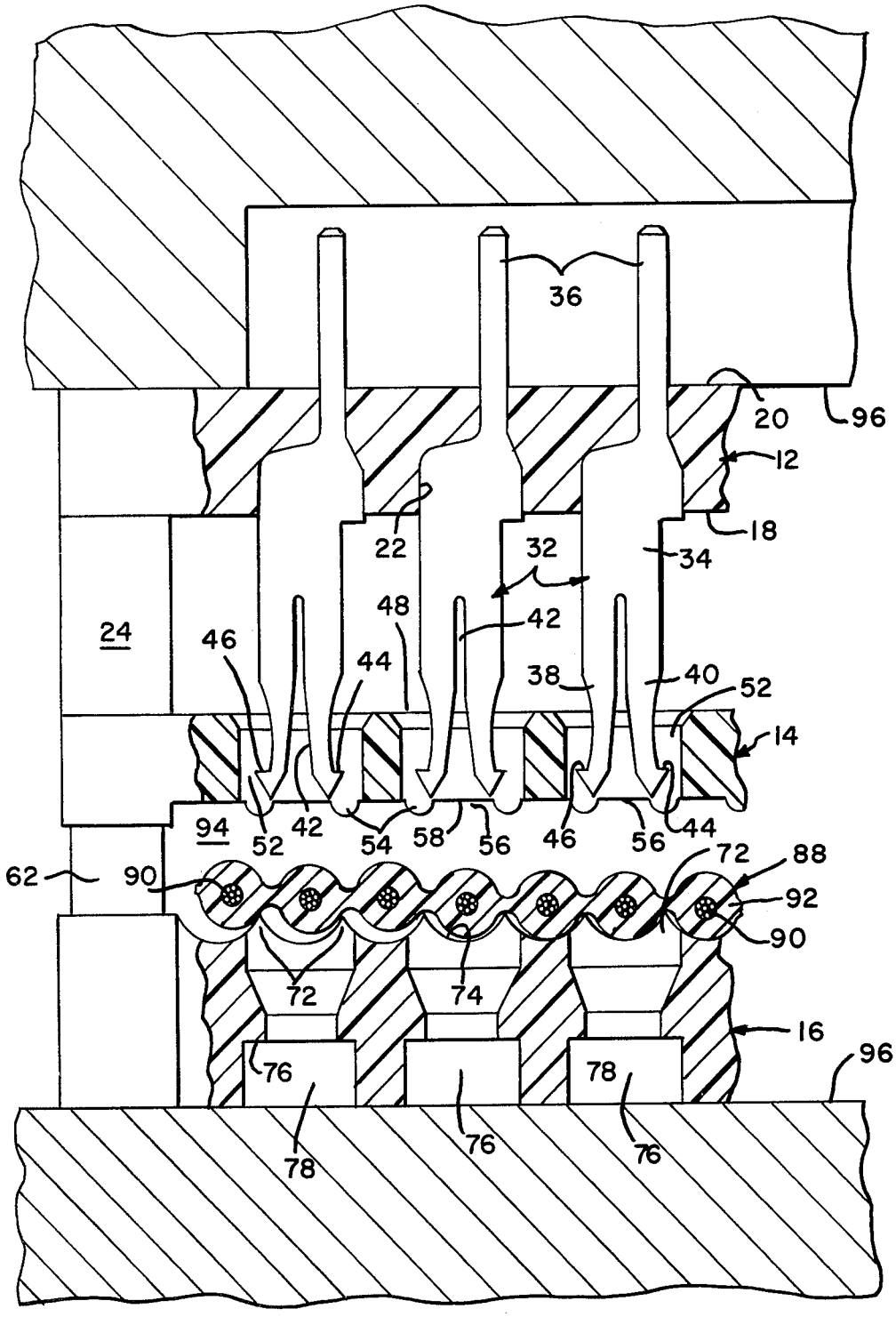
FIG. 3 is a vertical, transverse cross section through an end portion of the subject connector with a cable positioned therein.
Figure 4:
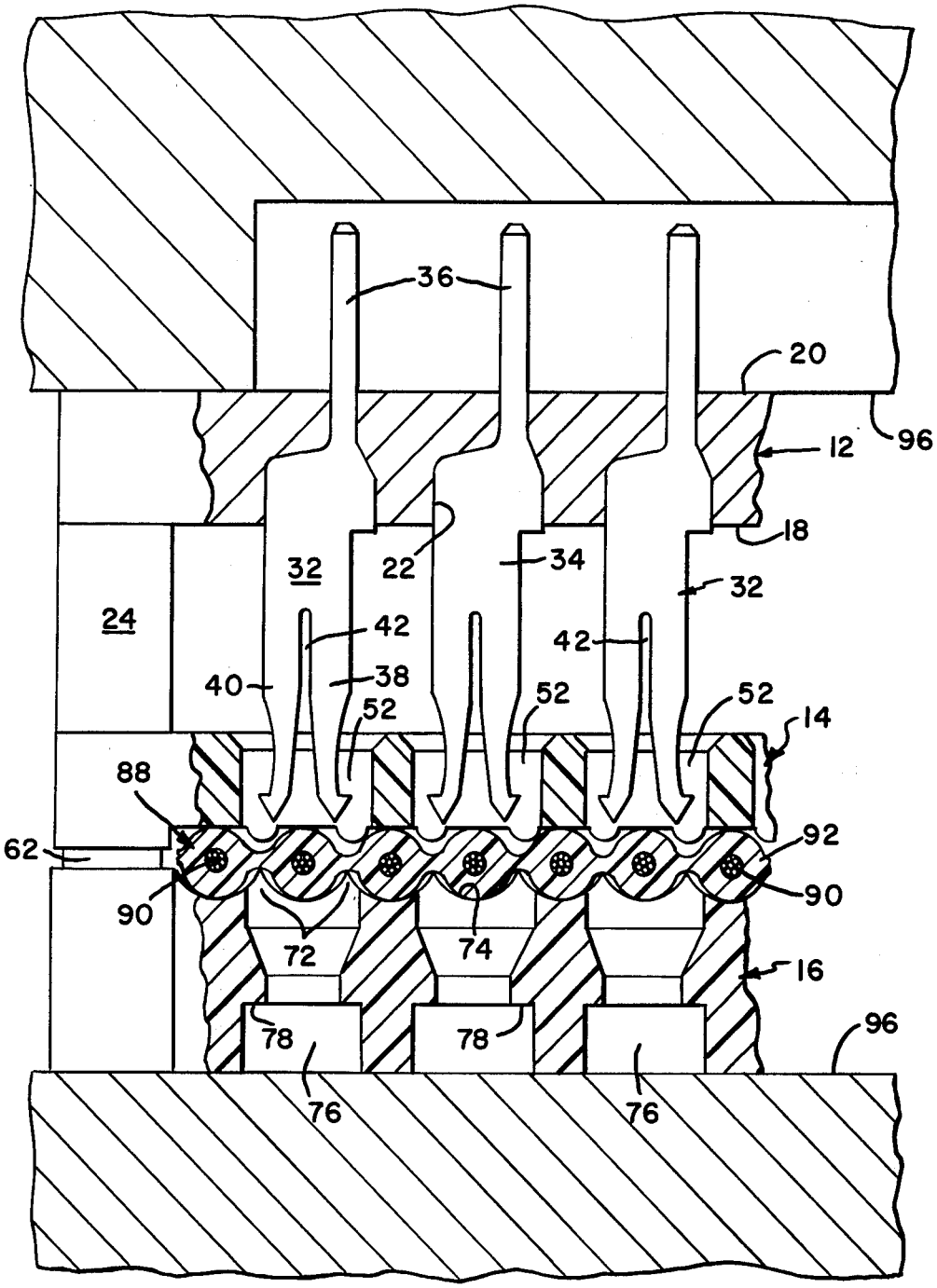
FIG. 4 is a view similar to FIG. 3 showing the subject connector in an intermediate position during termination of the cable.
Figure 5:
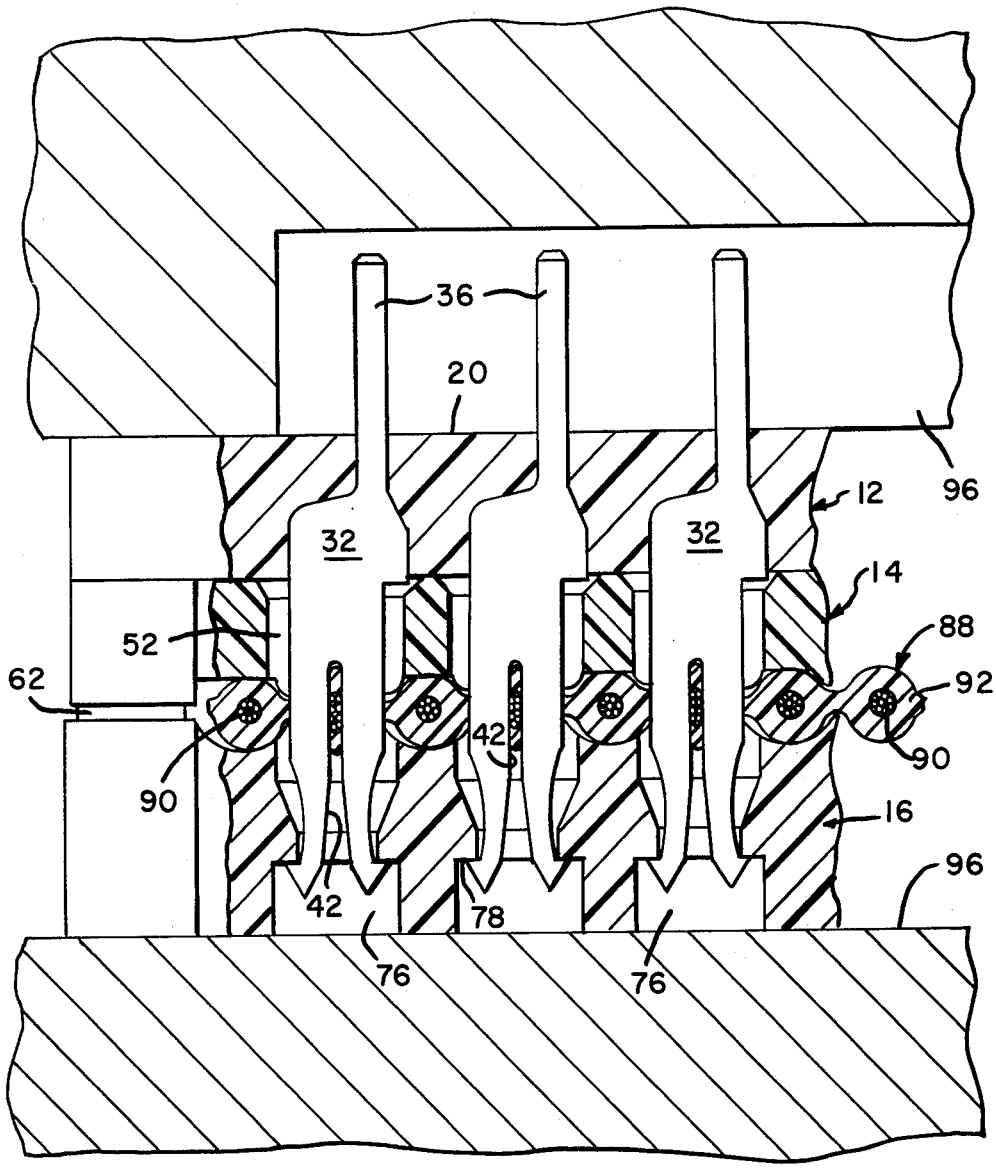
FIG. 5 is a view similar to FIGS. 3 and 4 showing the subject connector in a fully terminated condition.

The subject connector 10 would be delivered to the customer in the assembled condition shown in FIG. 2. In order to terminate the cable 88, which comprises a plurality of conductors 90 embedded in a layer of insulation 92, it is only necessary for the customer to insert the cable 88 into the cavity 94 defined between the intermediate and cover members 14 and 16, respectively, and to drive the members together in a press 96 or like suitable tooling. A compressive force applied to the assembly will cause the cover member 16 to slide down studs 62, 64 until surfaces 50 and 70 are closely spaced with channels 56, 74 defining passageways which will force conductors 90 of the cable 88 to their proper positions (see FIG. 4). Continued compressive force will overcome the interference of the recesses 58, 60 of the intermediate member 14 with the studs 24, 26 of the base member 12 and allow relative movement of the base and intermediate members to drive the portions 34 of terminals 32 into engagement with the respective conductors 90 of the cable 88 (see FIG. 5). The sequence of making a termination are shown in FIGS. 3, 4, and 5 as explained above. It will also be noted from FIG. 5 that the shoulders 44, 46 of the terminals 32 will latchingly engage the shoulders 78 in the cover member 16 thus holding the assembly together across its entire length and width. This eliminates the necessity to have external or supplemental clamping means to hold the assembly together.

The present invention may be subject to many modifications and changes without departing from the spirit or essential characteristics thereof. The above described embodiment should therefore be considered in all respects as illustrative and not restrictive of the scope of the invention.

What is claimed is:

1. A connector assembly for terminating multi-conductor flat flexible cable, said assembly comprising:

a housing of insulative material having a base member, an intermediate member, and a cover member, each said member having an aligned array of slots passing through the major surfaces thereof, first spacer means holding said intermediate member and said cover member in alignment with each other, second spacer means holding said intermediate member in alignment with said base member;

said first spacer means comprising by at least one stud on one of said cover and said intermediate members and a like recess in the other of said members aligned with a respective stud, each said stud having a stepped profile and being received in a respective recess with frictional fit so that said members are held in a spaced apart condition and a second frictional fit are held in a first spaced apart condition or in a second condition closed against said cable, and are moved with respect to each other only upon application of force, a plurality of electrical terminals mounted in said base member, each said terminal having a first mating end and an oppositely directed insulation piercing conductor engaging end directed towards a respective slot in said intermediate member whereby a cable is terminated by first compressing it between said cover and said intermediate members to hold the conductors thereof in an aligned condition and then driving the terminals into said cable to make contact therewith.

2. A connector according to claim 1 wherein opposed faces of said cover member and said intermediate member have profiled surfaces defining a plurality of conductor channels in accurate parallel, spaced alignment.

3. A connector according to claim 1 wherein said at least one stud and like recess of said first spacer means are profiled for polarized mating of said members.

4. A connector according to claim 1 wherein said second spacer means comprises:

at least one stud on one of said intermediate and said base members and a like recess in the other of said members aligned with a respective stud, each said stud having a stepped profile and being received in a respective recess with differential interference fit with the tighter fit holding said members in a closed condition whereby said base and said intermediate members are moved with respect to each other only upon application of force.

5. A connector according to claim 1 wherein said first and said second spacer means are profiled and positioned for polarized mating of said members.

6. A connector according to claim 1 wherein each said insulating piercing conductor engaging end of said terminals comprises:

a pair of tines defining a conductor engaging slot therebetween, each tine having a sharpened free end and an outwardly directed shoulder, and each said slot in said cover member having a shoulder whereby in a terminated condition the shoulders of said tines engage respective shoulders of said cover member to securely clamp the connector members together across the entire width of the cable.

7. A connector assembly for terminating multi-conductor flat flexible cable, said assembly comprising:

a housing of insulative material having a base member, an intermediate member, and a cover member, each said member having an aligned array of slots passing through the major surfaces thereof, first spacer means holding said intermediate member and said cover member in alignment with each other, second spacer means holding said intermediate member in alignment with said base member, said second spacer means comprising at least one stud on one of said base and said intermediate members and a like recess in the other of said members aligned with a respective stud, each said stud having a stepped profile providing differential interference fit between said base and intermediate members and being received in a respective recess with interference fit so that said members are moved with respect to each other only upon application of force with the tighter fit holding said members in their closed condition, a plurality of electrical terminals mounted in said base member, each said terminal having a first mating end and an oppositely directed insulation piercing conductor engaging end directed towards a respective slot in said intermediate member whereby a cable is terminated by first compressing it between said cover and said intermediate members to hold the conductors thereof in an aligned condition and then driving the terminals into said cable to make contact therewith.

8. A connector according to claim 7 wherein opposed faces of said cover member and said intermediate member have profiled surfaces defining a plurality of conductor channels in accurate parallel, spaced alignment.

9. A connector according to claim 7 wherein each said insulating piercing conductor engaging end of said terminals comprises:

a pair of tines defining a conductor engaging slot therebetween, each tine having a sharpened free end and an outwardly directed shoulder, and each said slot in said cover member having a shoulder whereby in a terminated condition the shoulders of said tines engage respective shoulders of said cover member to securely clamp the connector members together across the entire width of the cable.

10. A connector according to claim 7 wherein said first spacer means comprises:

at least one stud on one of said cover and said intermediate members and a like recess in the other of said members aligned with a respective stud, each said stud having a stepped profile and being received in a respective recess with frictional fit, a first frictional fit holding said cover and intermediate members in a spaced apart condition and a second frictional fit holding said cover and intermediate members close against said cable, said members being moved with respect to each other only upon application of force.

11. A connector according to claim 10 wherein first and said second spacer means are profiled for polarized mating of said members.

* * * * *